US006669017B2

(12) United States Patent
Linihan

(10) Patent No.: US 6,669,017 B2
(45) Date of Patent: Dec. 30, 2003

(54) PROTECTIVE COVER FOR A KEY FOB

(76) Inventor: Michael Linihan, 623 Parkdale, Royal Oak, MI (US) 48073

( * ) Notice: Subject to any disclaimer, the term of this patent is extended or adjusted under 35 U.S.C. 154(b) by 0 days.

(21) Appl. No.: 09/865,853

(22) Filed: May 26, 2001

(65) Prior Publication Data

US 2002/0175096 A1 Nov. 28, 2002

(51) Int. Cl.[7] ..... A45C 11/32

(52) U.S. Cl. ..... 206/305; 206/37; 206/37.1; 206/459.5

(58) Field of Search ..... 206/37, 38, 38.1, 206/39, 305, 320, 523, 459.5, 37.1; 248/309.1

(56) References Cited

U.S. PATENT DOCUMENTS 4,511,167 A * 4/1985 Kawaguchi ..... 294/28
4,573,573 A * 3/1986 Favaro ..... 206/305
4,703,161 A * 10/1987 McLean ..... 206/523
4,824,059 A * 4/1989 Butler ..... 206/523
4,896,805 A * 1/1990 Klaczak et al. ..... 224/901
5,305,980 A * 4/1994 Le Blanc ..... 248/309.1
5,388,691 A * 2/1995 White ..... 206/305
5,388,692 A * 2/1995 Withrow et al. ..... 206/320
5,850,754 A * 12/1998 Dobbins ..... 206/37

* cited by examiner

*Primary Examiner*—Jim Foster

(57) ABSTRACT

A protective cover for a remote keyless entry key fob having at least one communication button, the protective cover including a body section having a first side and an oppositely disposed second side, and a cavity defined by the body section adapted to receive the key fob, wherein at least one of the first or second sides includes an aperture such that the key fob is accessible through the aperture and an "O" ring disposed between the key fob and the protective cover for providing a press fit connection between the protective cover and the key fob such that the key fob is positively located within the protective cover.

11 Claims, 4 Drawing Sheets

PROTECTIVE COVER FOR A KEY FOB

TECHNICAL FIELD

This invention relates to a protective cover for a key fob and more specifically to a protective cover for a remote keyless entry key fob having communication button on the exterior of the key fob.

BACKGROUND ART

Keyless remote entry has become prevalent in its inclusion in new vehicle accessories. More specifically, the use of key fob type mechanisms which allow for the locking and unlocking of vehicle door lock systems, the opening of truck latch mechanisms and the setting and unsetting of alarm systems has become commonplace in new vehicle accessories. High end, as well as low end, vehicles are including the above noted functions as well as other functions in standard accessory packages. In this manner, the importance of the protection of remote keyless entry key fobs is rising.

As the public begins to rely more on more on these key fobs systems, it becomes imperative to protect and preserve the electrical circuitry of these devices. The introduction of moisture either by rain, mist or inadvertent dropping in water puddles near the vehicle inevitably occurs in common use of the key fobs. The introduction of foreign particle such as dust, dirt and sand also occurs through common use and over time begins to degrade if not completely hinder the normal operation of the key fob. In addition, as the key fob is often, if not entirely kept along with the car keys and other house keys, the common use also entails inadvertent dropping, knocking banging and hitting the key fob against hard objects. This continuous physical shock to the key fob over time begins to degrade if not completely hinder the normal operation of the key fob.

Consequently, a need exists for a protective cover for the remote keyless entry key fob. A system that will allow full implementation of all the communication buttons on the system while still providing protection for the key from the above noted hazardous conditions will greatly improve the longitivity of the key fob.

DISCLOSURE OF THE INVENTION

It is a principal object of the present invention to provide a protective cover for a key fob such that the key fob is shield from moisture, foreign particles and unwanted shock from inadvertent dropping of the key fob by the user.

It is a further object of the present invention to provide a protective cover for a key fob that includes a buoyancy feature such that the key fob when included within the protective cover will float in water.

It is still another object of the present invention to provide a protective cover for a key fob that allows the user to access the full compliment of communication buttons located on the key fob.

It is yet another object of the present invention to provide a protective cover for a key fob that accepts at least 60% of the key fob.

Yet still further, it is an object of the present invention to provide a protective cover for a key fob that accepts the entire body of the key fob.

Still further, it is an object of the present invention to provide a protective cover for a key fob that includes a advertising section for accepting either an attachment emblem or sticker, an embossed indicia or a molded in recessed indicia.

In carrying out these and other objects, features and advantages of the present invention, there is provided a protective cover for a key fob including a body section having a first side and an oppositely disposed second side, and a cavity defined by the body section adapted to receive at least 60% of the key fob, wherein at least one of the first or second sides includes an aperture such that the key fob is accessible through the aperture.

In a preferred embodiment, the cavity is disposed directly adjacent the communication buttons located on the key fob to allow for access to the complete compliment of functions allowed by the key fob.

Multiple embodiments of the protective cover are contemplated by the present invention as in manufacture of the protective cover in foam rubber, carbon reinforced polymers, resins, thermoset and thermoplastics, metals and rubbers compounds wherein each material affords advantageous features to the protective cover.

The above objects and other objects, features and advantages of the present invention are readily apparent from the following detailed description of the best mode for carrying out the invention when taken in connection with the accompanying drawings.

BEST MODE FOR CARRYING OUT THE INVENTION

Figure 1:
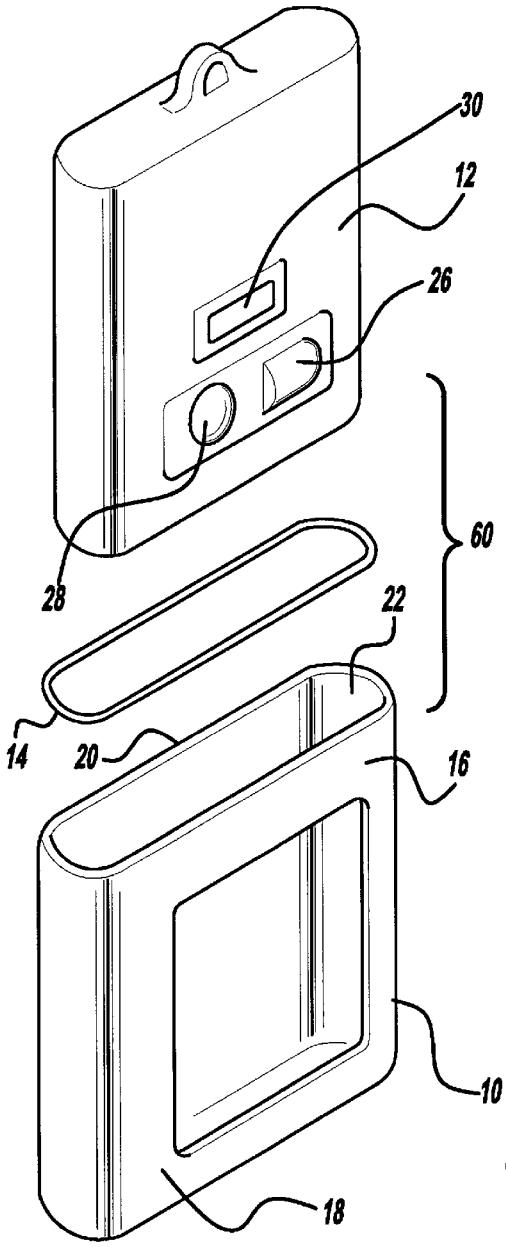
FIG. 1 is an exploded perspective view of the protective cover system of the present invention including the protective cover, "O" ring and remote keyless entry key fob.

As shown in FIG. 1, there is shown generally, a protective cover 10 for a key fob 12. "O" ring 14 is disposed between protective cover 10 and key fob 12. The protective cover 10 includes a body section 16 having a first side 18 and an oppositely disposed second side 20. A cavity 22 is defined by the body section. The body section is configured to receive at least 60% of the key fob 12. It is contemplated by the present invention that, depending on the key fob 12 design and shape, that anywhere from 60 to 100% of the key fob can be situated within the cavity of the body section.

Figure 2:
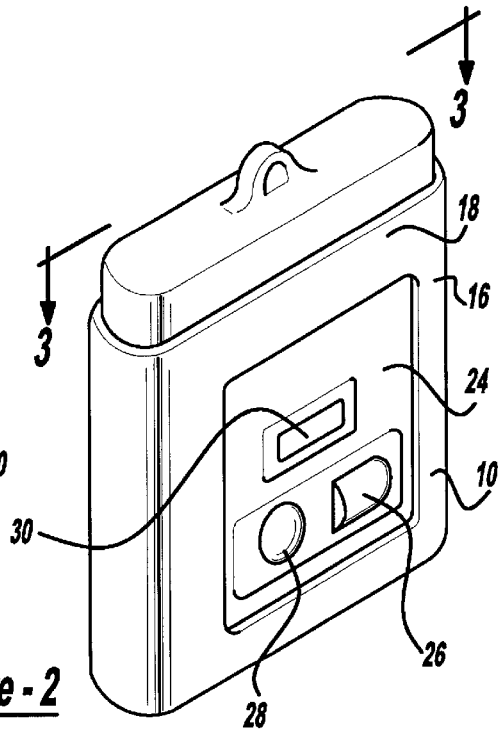
FIG. 2 is a perspective view of the protective cover system of FIG. 1 in the assembled position.

As shown in FIGS. 1 and 2, first side 18 includes an aperture 24. Aperture 24 is designed to allow the key fob 12 to be accessible through said aperture 24. More specifically, as shown in FIGS. 1 and 2, key fob 12 is a remote keyless entry key fob having at least one communication button 26. Aperture 24 is disposed directly adjacent the communication button 26 to allow a user to operate the communication button 26. In FIG. 2, the other communication buttons 28 and 30 are also fully accessible through aperture 24 allow the full compliment of operations to be operated while the remote keyless entry key fob 12 is located within the protective cover 10.

Figure 3:
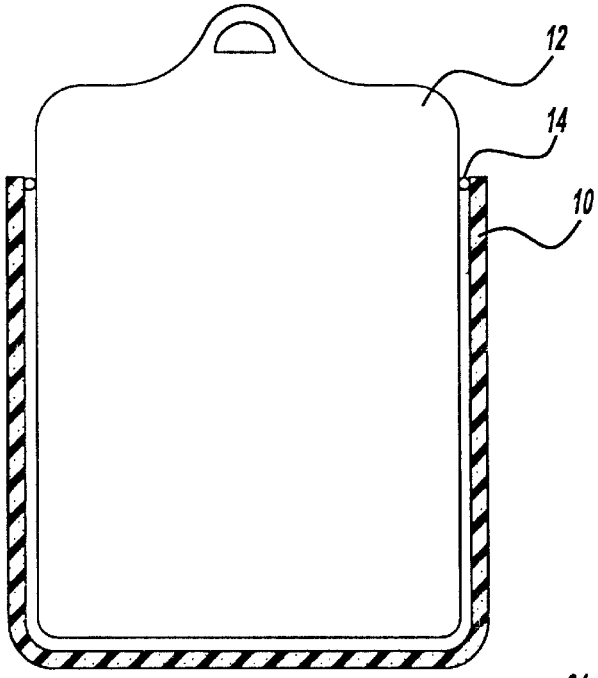
FIG. 3 is a cross sectional view of the protective cover system of FIG. 1 in the assembled position taken along lines 3—3 of FIG. 1.
Figure 5A:
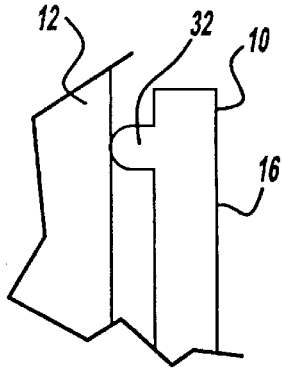
FIG. 5*a* is a partial, top view of the protective cover of the present invention showing an alternative embodiment of the body section.

Referring now to FIG. 3, there is shown "O" ring 14 disposed between protective cover 10 and key fob 12. "O" ring 14 is disposed between the key fob 12 and protective cover 10 for providing a press fit connection between the protective cover 10 and the key fob 12. Further the "O" ring 14 allows the key fob 12 to positively located or situated within the protective cover 10. The "O" ring 14 also prevents dirt, water or other foreign particles from entering the space between the protective cover 10 and the key fob 12. As shown in FIG. 5A, there is shown body section 16 including an integrally molded extending lip 32 for providing the above noted a press fit connection between the protective cover 10 and the key fob 12 such that the key fob is positively located within said protective cover as discussed above.

Figure 5:
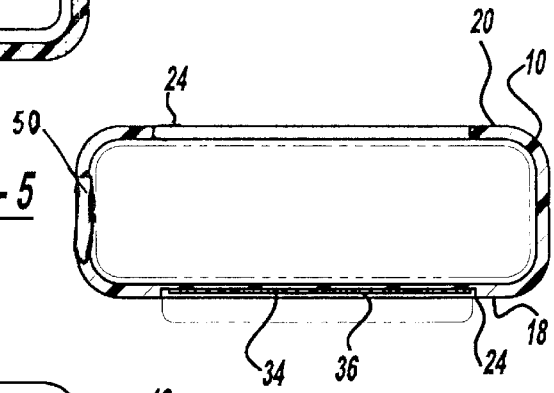
FIG. 5 is a cross sectional view of the protective cover of FIG. 4 taken along lines 5—5 of FIG. 4.
Figure 4:
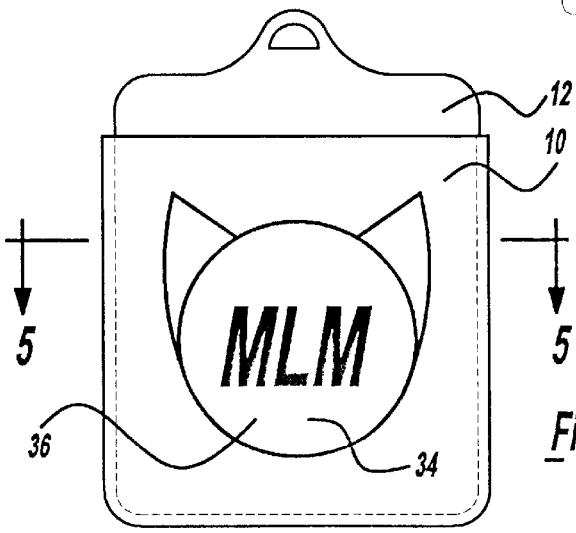
FIG. 4 is a side view of the protective cover of the present invention showing the advertising section having an embossed indicia.
Figure 7:
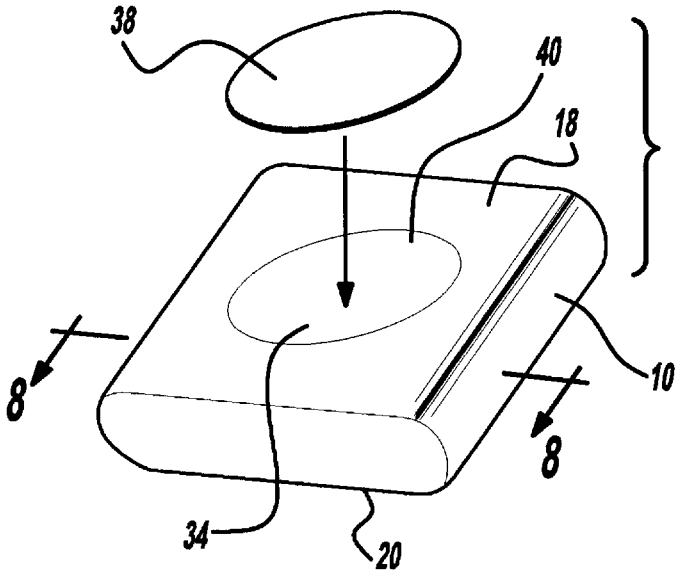
FIG. 7 is a perspective view of the protective cover of the present invention illustrating the advertising section and an unapplied applique indicia.

FIG. 4 illustrates the protective cover 10 including an advertising section 34. Advertising section 34 is located on the opposite side of the body section 16 having the aperture 24. More specifically, as seen in FIG. 5, aperture 24 is located on second side 20 and advertising section 34 is located on first side 18. In FIGS. 4 and 5 there is shown a raised or embossed indicia 36 which can be any symbol, character or word etc. which may be desirable for location on the protective cover. As shown, the key fob communication buttons are completely accessibly to the user while also allowing the advertising section to display some form of indicia 36. Referring now to FIG. 7, the indicia may also take the form of a applique or sticker 38. The advertising section may be a raised, lowered or flat section 40. In addition, the present invention contemplated integrally molding or machining any form of indicia 36 directly in the advertising section 34 of the body section 18.

Figure 8:
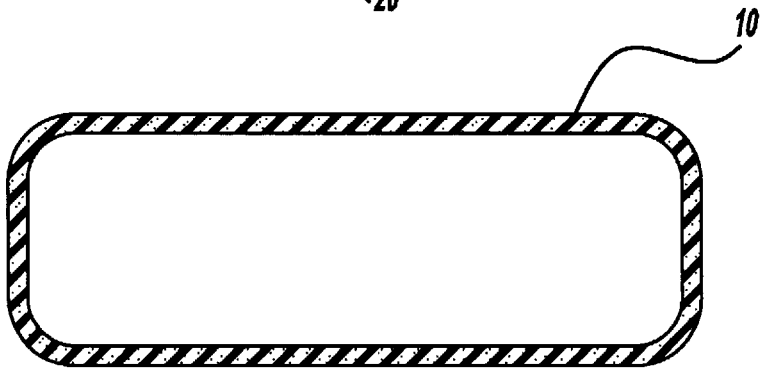
FIG. 8 is a cross sectional view of the protective cover of FIG. 7 taken along lines 8—8 of FIG. 7.
Figure 9:
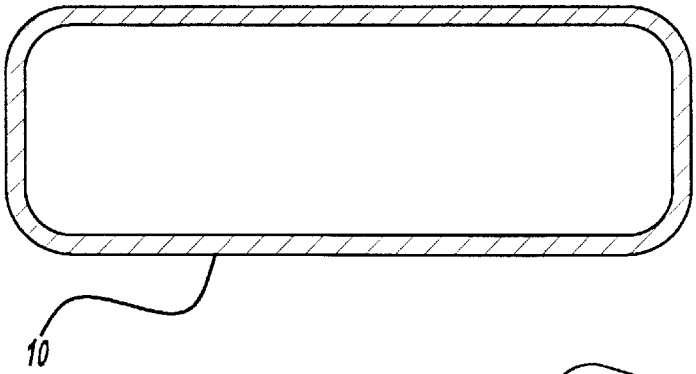
FIG. 9 is a cross sectional view of an alternative embodiment of the protective cover.

According to the present invention the protective cover 10 may be made from different materials. The protective cover 10 may be from foam rubber, carbon reinforced polymers, resins, thermoset and thermoplastics, metals and rubbers compounds wherein each material affords advantageous features to the protective cover 10. As shown in FIGS. 1, 2, 4, and 5 the protective cover 10 is made from a carbon reinforced plastic or polymer. In FIG. 8, the protective cover 10 is made from a closed cell foam rubber. In FIG. 9, the protective cover 10 is made from a metal, specifically aluminum. As shown in FIG. 3, the protective cover 10 may be made from a composite polymeric material including an internal cloth design having a weaved twill pattern. Various patterns and composite combinations, as known in the art, may be used to obtain different structural features for the protective cover 10.

As noted above, in FIG. 8, the protective cover is made from a foam rubber. More specifically the foam rubber is a closed cell foam rubber. This construction affords the protective cover with the dual properties of excellent protection of the key fob 12 from external physical shocks due to inadvertent dropping of the key fob 12. The foam rubber insulates, protects and absorbs the shock of the key fob hitting most hard surfaces in normal conditions. Further, the closed cell foam rubber is designed such that the protective cover 10 and key fob 12 will float if dropped in water. This is particularly useful for users having both boat key and automotive vehicles keys or key fobs on one ring.

Figure 6:
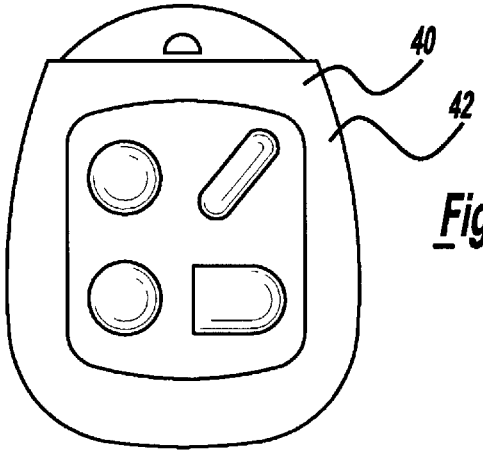
FIG. 6 is a side view of an alternative embodiment of the protective cover system of the present invention illustrating a different shape key fob.
Figure 10:
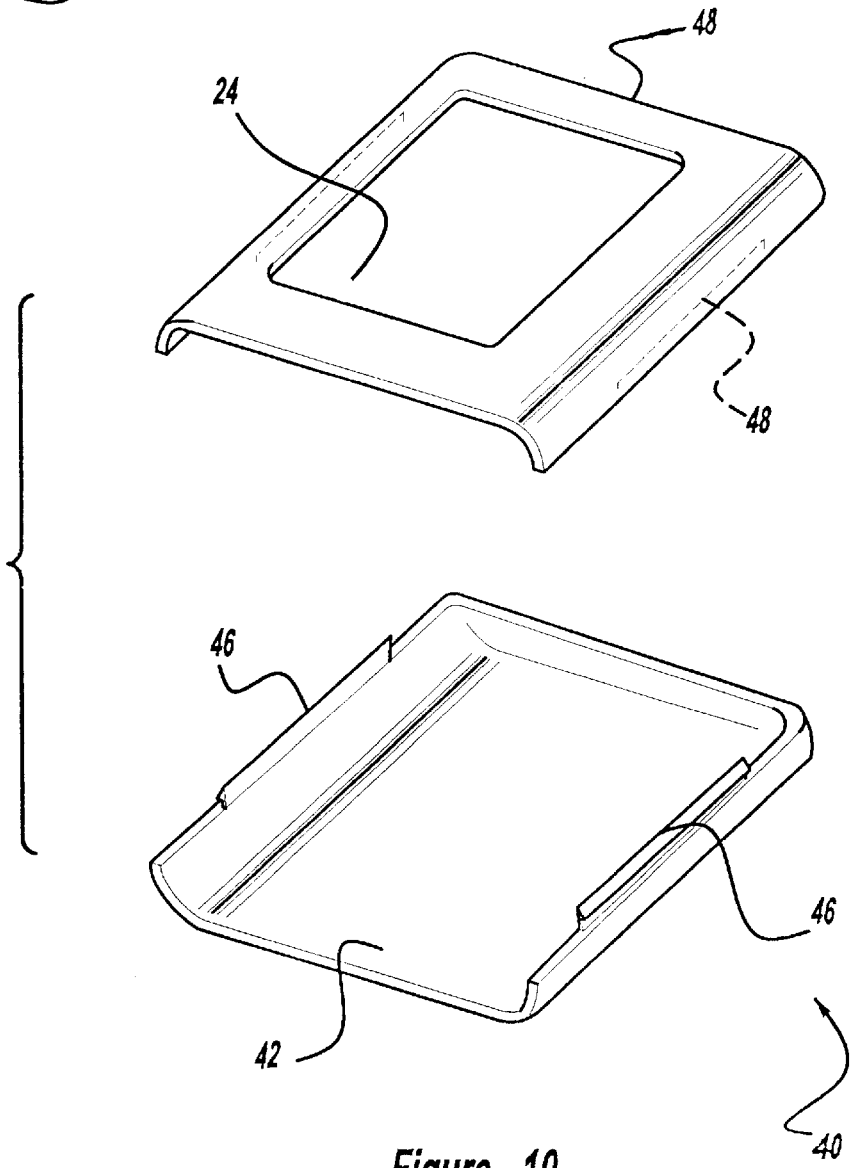
FIG. 10 is an exploded view of yet another alternative embodiment of the present invention.

Referring now to FIG. 10, there is shown an alternative embodiment of the present invention. Protective cover 40 is comprised of a first section 42 and a second section 48. The first and second sections are attached together in a snap fit manner by the use of interlocking tabs 46. The interlocking tabs cooperate with the tab retainer sections 48 shown in phantom. The present inventions contemplates the use of any attachment means such as the use of adhesives in glueing, melting or heat sealing screw types systems for attaching the first and second sections together. As shown in FIG. 6, the key fob is of an irregular shape and the use of a two piece protective cover construction such as described herein and disclosed in FIG. 10 allows the protective cover to be fit over any form or key fob shape.

Referring now to FIG. 5, there is shown first side 18 having molded integrally therein a buoyancy pocket 50 for adding to the buoyancy of the protective cover. In this manner, as discussed above, the protective cover 10 and key fob 12 will float if dropped in water. The buoyancy pocket 50 is yet another means for allowing the protective cover and key fob to float in water.

It is known that the public is using remote keyless entry key fobs, and it is imperative to protect and preserve the electrical circuitry of these devices. The present invention of a remote keyless entry system 60 comprising a remote keyless entry key fob 12 having at least one communication button 26, a protective cover 10 including a body section 16 and a first side 18 and an oppositely disposed second side 18, and a cavity 20 defined the body section a 16 adapted to receive at least 60% of said remote keyless entry key fob 12 and an "O" ring 14. The remote keyless entry system using the protective cover 10 of the present invention protects the key fob 12 against the introduction of moisture either by rain, mist or inadvertent dropping in water puddles near the vehicle inevitably occurs in common use of the key fobs. The blocking or hindering of the introduction of foreign particle such as dust, dirt and sand lengthens the normal operating life of the key fob 10. As shown in FIG. 3, there exists a pocket 52 defined between the protective cover 10 and key fob 12. This pocket 52 acts as a buffer when in the common use, the key fob 12 is inadvertently dropped, knocked banged or hit against hard objects. This reduction in the effects of the continuous physical shock to the lengthens the normal operating life of the key fob 12.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A protective cover for a remote keyless entry key fob having at least one communication button, said protective cover comprising:

a body section having a first side and an oppositely disposed second side, and a cavity defined by said body section adapted to receive at least 60% of the key fob, wherein at least one of said first or second sides includes an aperture such that the key fob is accessible through said aperture; and an "O" ring disposed between the key fob and said protective cover for providing a press fit connection between said protective cover and the key fob such that the key fob is positively located within said protective cover.

2. A protective cover as in claim 1, wherein said aperture is disposed directly adjacent the communication button to allow a user to operate the communication button.

3. A protective cover as in claim 1, wherein one of said first or second sides includes an aperture such that the key fob is accessible through said aperture and said other side includes an advertising section for receiving an indicia.

4. A protective cover as in claim 1, wherein said body section includes a buoyancy means for allowing said protective cover and the key fob to float in water.

5. A protective cover as in claim 4, wherein said buoyancy means is an air pocket molded into said protective cover.

6. A protective cover as in claim 1, wherein said body section is made from foam rubber.

7. A protective cover as in claim 1, wherein said body section is made from a reinforced polymer.

8. A protective cover as in claim 1, wherein said body section is made from metal.

9. A protective cover as in claim 4, wherein said buoyancy means is manufacturing a portion of said body section from a closed cell foam rubber.

10. A protective cover as in claim 1, wherein said body section is made from a composite material including a cloth design having a weaved twill pattern.

11. A remote keyless entry system comprising:

a remote keyless entry key fob having at least one communication button;

a protective cover including a body section having a first side and an oppositely disposed second side, and a cavity defined by said body section adapted to receive at least 60% of said remote keyless entry key fob, wherein at least one of said first or second sides includes an aperture such that said remote keyless entry key fob is accessible through said aperture and said aperture is disposed directly adjacent said communication button to allow a user to operate said communication button; and an "O" ring disposed between remote keyless entry key fob and said protective cover for providing a press fit connection between said protective cover and the key fob such that the key fob is positively located within said protective cover.

* * * * *